United States Patent [19]

Skoog

[11] Patent Number: 4,489,778

[45] Date of Patent: Dec. 25, 1984

[54] PLATE HEAT EXCHANGER

[76] Inventor: Malte Skoog, Stjärngatan 20, Lund S-223 57, Sweden

[21] Appl. No.: 471,288

[22] Filed: Mar. 2, 1983

[30] Foreign Application Priority Data

Mar. 4, 1982 [SE] Sweden ..... 8201328

[51] Int. Cl.[3] ..... F28F 3/04; F28F 13/06

[52] U.S. Cl. ..... 165/166

[58] Field of Search ..... 165/166, 167

[56] References Cited

U.S. PATENT DOCUMENTS 4,176,713 12/1979 Fisher ..... 165/167 X
4,303,123 12/1981 Skoog ..... 165/166
4,376,460 3/1983 Skoog ..... 165/167

FOREIGN PATENT DOCUMENTS 2066938 7/1981 United Kingdom ..... 165/166

*Primary Examiner*—Sheldon J. Richter

*Attorney, Agent, or Firm*—Ladas & Parry

[57] ABSTRACT

A heat exchanger comprising a plurality of plates arranged adjacent to each other, whereby passages for two mutually heat exchanging fluids are formed between the plates. The plates comprise corrugations or ridges, whereby the corrugations form an angle with the longitudinal rim of the plate. In the first type of plates the corrugations form a first angle with said rim and in the second type of plates the corrugations form a second angle with the rim. The plates are combined in order to form two types of passages having different thermal length. The first type of passage is obtained by combining a first plate and a second plate and the second type of passage is formed by combining a first plate and a second plate, wherein one of the plates is turned 180° in its own plane. Thus, two types of passages having different thermal lengths are obtained. The two types of passages can be combined for each heat exchanging fluid in order to provide the desired thermal length for that fluid.

4 Claims, 7 Drawing Figures

PLATE HEAT EXCHANGER

The present invention relates to a heat exchanger comprising a plurality of plates arranged adjacent to each other and forming between them sealed passages for two mutually heat exchanging fluids. In more detail, the invention relates to a heat exchanger in which the heat exchanging areas of the plates have ridges or corrugations crossing the ridges or corrugations of the adjacent plates, whereby areas are created in said passages in which the fluids are subjected to a heavy turbulence.

In conventional heat exchangers the plates are of one type disposed in such a way that every other plate is turned 180° in its own plane in relation to the rest of the plates. The passages obtained thereby are thermally of the same kind or have a certain thermal length and are adapted to certain heat exchange duties only.

Another plate having e.g. differently shaped ridges would, in a conventional arrangement, provide passages which would have another thermal length but are still adapted to only certain, although different, heat exchange duties.

Since tools for the manufacture of heat exchange plates are very expensive, it is necessary for each manufacturer to delimit his assortment of plates which means in practice that most of the heat exchange duties cannot be fulfilled in the most economical way in a conventional arrangement. In this situation it has appeared appropriate, in one and the same heat exchanger to provide passages which have two thermal lengths. By selecting an appropriate number of passages of the two thermal lengths, a heat exchanging fluid flowing simultaneously through both kinds of passages will be subjected to a preferred change of temperature which is between the changes of temperature provided by flowing the fluid through passages of only the first or the second thermal length.

According to a previously known method, passages of different thermal lengths are provided by means of two types of plates having an angle- or arrow-like corrugation pattern. The corrugation pattern forms an angle with the longitudinal rim of the plate. In the first type of plates, the corrugations form a first angle with said rim and in the second type of plates the corrugations form a second angle with the rim. Passages are formed between plates of the same type, and between plates of different type. In all said passages the adjacent plates have the corrugations crossing each other and pointing in opposite directions. However, this arrangement means that the number of passages for each heat exchanging fluid will be equal, apart from the possible difference in the first and/or last passage of the plate pack. Thus, the method provides no possibility, or in any case an extremely limited possibility, to select a certain thermal length for one fluid and another thermal length for the other fluid.

This problem has been solved in the prior art by causing the fluids to flow simultaneously through passages of different thicknesses (and thence different thermal lengths). According to another known method the fluids are simultaneously flowing through passages in which the ridges of adjacent plates cross each other, and passages in which the ridges of the adjacent plates extend in parallel.

However, the two last-mentioned methods have several drawbacks. Thus, the first-mentioned method requires special arrangements relating to e.g. gaskets and spacing means in the passages which have a thickness differing from those which are normal for the plates concerned. The last-mentioned method results in a reduced pressure-resistant capacity and less turbulence in the passages having parallel ridges as compared to passages in which the ridges cross each other.

According to the present invention the above described disadvantages have been eliminated. The heat exchanger according to the invention comprises several types or variants of plates, wherein in the first type of plates the corrugations form a first angle with the rim of the plate and in the second type of plates the corrugations form a second angle with the rim of the plate. The two types of plates are disposed alternately, i.e. each plate of the first type in the pack is followed by a plate of the second type. In spite of the fact that each passage is defined by plates of different types, passages of different thermal lengths are provided by disposing two adjacent plates with the corrugations directed in the same direction, whereby the corrugations cross each other with a first angle which gives a first thermal length, and by disposing two adjacent plates with the corrugations directed in the opposite directions, whereby the corrugations cross each other with a second angle which gives a second thermal length. Thus, the plates can be combined in order to obtain passages of different thermal lengths.

The invention will be described in more detail below with reference to the accompanying drawing, wherein FIGS. 1 and 2 are schematic plan views showing two plates which will build up the heat exchanger according to the invention.

FIGS. 6 and 7 are schematic plan views, wherein FIG. 6 shows conventional plates and FIG. 7 shows complementing plates according to the invention.

Figure 1:
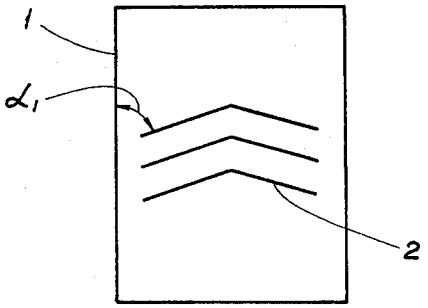
Figure 2:
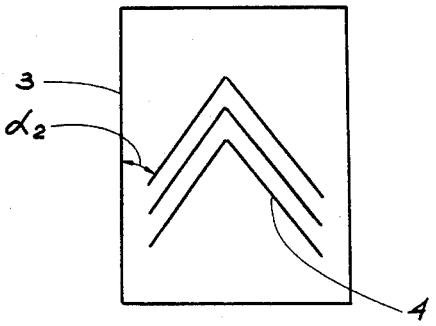

In FIG. 1, a first plate 1 is schematically shown and is provided with a plurality of turbulence generating corrugation ridges 2 which extend at a first angle $\alpha_1$ relative to the longitudinal axis of the plate. FIG. 2 is a schematical view of a second plate 3 having a plurality of corrugation ridges 4 extending at a second angle $\alpha_2$ relative to the axis of the plate. The plates shown have their corrugations arranged in a so-called single arrow pattern, but other designs of the corrugation pattern are possible within the scope of the invention. When the plates are positioned adjacent each other, the ridges 2, 4 cross and abut each other to form supporting points between the plates 1, 3 when disposed adjacent to each other. This is the case irrespective of the mutual position of the plates, i.e. when the plates are put together directly as well as when one of the plates is turned 180° in its own plane or around a vertical or horizontal axis in its own plane.

Figure 3:
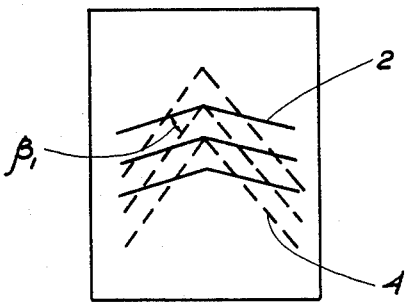
FIGS. 3 and 4 are schematic plan views illustrating how the ridges of adjacent plates disposed according to FIGS. 1 and 2 may cross each other.
Figure 4:
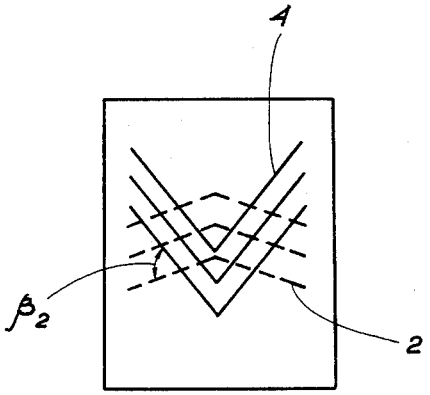

If the corrugation is symmetrical, i.e. if the grooves and ridges are similar on both sides of the plate, it is possible to obtain passages of two different theraal lengths. This is apparent from FIGS. 3 and 4 in which the ridges 2 of the plate shown in FIG. 1 cross the ridges 4 of the plate shown in FIG. 2 when the plates are disposed adjacent to each other with the ridges directed in the same and the opposite direction, respectively. If the corrugations of one of the plates, or both, are unsymmetrical, passages of further different thermal length can be obtained.

The difference between the first angle $\alpha_1$ between the corrugations and the rim of the first plate and the corresponding second angle $\alpha_2$ of the second plate should be big enough to ensure a sufficient number of supporting points in the passages, even with the first crossing angle $\beta_1$. However, the difference should not be so large, that the thermal lengths of the different passages will be too similar.

By allowing a fluid to flow simultaneously through passages of the first type in which the corrugations of the adjacent plates cross each other at the first angle $\beta_1$, and passages of the second type in which the corrugations of the adjacent plates cross each other at the second angle $\beta_2$, the fluid is subjected to a change of temperature which lies between the temperature changes obtained by flowing the fluid exclusively through passages of only one type or thermal length. By suitably electing the number of passages of the first and second types, it is possible to obtain approximately the desired change of temperature of the fluid.

What applies to the first fluid does also apply to the second fluid, and independently of the first fluid. It is thus possible to have one ratio between the number of passages of the first and the second types for the first fluid, and another ratio for the other fluid.

It is also possible to flow at least one of the fluids through passages of one type only.

Figure 5:
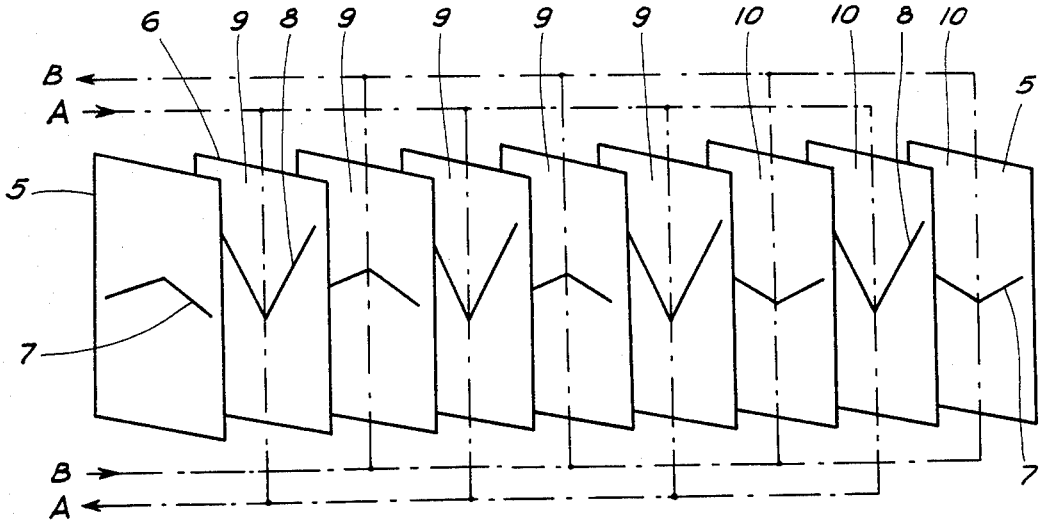
FIG. 5 is an exploded perspective view of an embodiment of the heat exchanger according to the invention.

FIG. 5 is an exploded, diagrammatical perspective view of an embodiment of the heat exchanger according to the invention. A first plate 5 and a second plate 6 which differ with respect to the angles $\alpha_1$, $\alpha_2$ of the corrugations 7, 8 are disposed alternately adjacent to each other to form first and second passages 9, 10 in which the corrugations 7, 8 of the adjacent plates intersect at different angles $\beta_1$ and $\beta_2$, respectively. A first heat exchanging fluid A flows simultaneously through three passages 9 and one passage 10, and a second heat exchanging fluid B flows simultaneously through two passages 9 and two passages 10.

Since the plates 5, 6 of the heat exchanger according to the present invention are alternately arranged, i.e. a first plate 5 followed by a second plate 6 and so on, there is no need for arranging passages defined by two identical (but oppositely directed) plates. This fact gives some inherent constructional advantages. Within the scope of the invention it is of course possible to use plates which may form passages defined by two plates of the same type.

Figure 6:
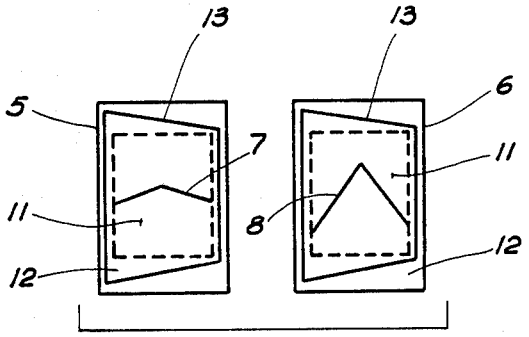

In FIG. 6 there is schematically shown two plates 5, 6 having heat exchanging surfaces 11 including ridges or corrugations 7, 8 having different inclination. The outer portions 12 of the plates, which include ports and distribution surfaces (not shown) and sealing means 13, have been made with the same tool and have such a shape that two plates 5 or two plates 6 can be combined in order to form a passage therebetween when one of the plates has been turned 180° in its own plane. It is also possible to achieve one and only one type of passage defined by one plate 5 and one plate 6. In this case the sealing means is an elastic packing, but the invention also includes plates interconnected by e.g. soldering.

Figure 7:
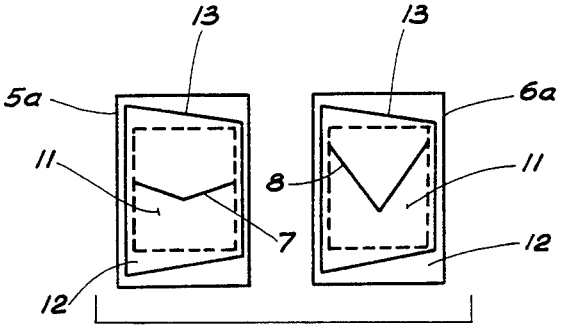

FIG. 7 shows how another two plates 5*a*, 6*a* have been made with the same tool parts only by turning the parts forming the heat exchanging surfaces 11 by 180° in relation to the tool part forming the outer portion 12 of the plate. Thus, the plates 5, 6, 5*a* and 6*a* can be assemblied to a heat exchanger according to the invention. For example, a plate 5 and a plate 6 (turned 180° in its own plane) form a passage having the second intersection angle ($\beta_2$) and a plate 5 and a plate 6*a* (turned 180° in its own plane) form a passage having the first intersection angle ($\beta_1$). Correspondingly, a plate 6 may be combined with a plate 5 or a plate 5*a*.

The above-mentioned embodiments have been described in order to clearify the invention, its objects and advantages but a skilled person can modify the embodiments described in many respects within the scope of the invention. The invention is only limited by the appended claims.

I claim:

1. Heat exchanger comprising a plurality of plates (5, 6), provided with corrugations (7, 8) and arranged adjacent to each other in order to define sealed passages (9, 10) therebetween for enclosing two separate mutually heat exchanging fluids, said plates being of a first type in which the corrugations form a first angle ($\alpha_1$) with the longitudinal rim of the plate, and of a second type in which the corrugations form a second angle ($\alpha_2$) with the longitudinal rim of the plate, and at least a portion of said plurality of plates being alternately arranged, i.e. a plate of the first type is followed by a plate of a second type and so on, wherein in said portion of alternately arranged plates a plurality of a first couple of plates are arranged with the corrugations thereof directed in the same direction, whereby the corrugations intersect at a first angle ($\beta_1$) in order to define first passages having a first thermal length, and a plurality of a second couple of plates are arranged with the corrugations thereof directed in the opposite directions, whereby the corrugations intersect at a second angle ($\beta_2$) in order to define second passages having a second thermal length.

2. Heat exchanger according to claim 1, wherein for at least one of the heat exchanging fluids a certain number of first and second passages are combined in order to achieve the desired thermal length for the fluid.

3. Heat exchanger according to claim 2, wherein for both heat exchanging fluids a certain number of first and second passages are combined in order to achieve the desired thermal lengths for the fluids.

4. Heat exchanger according to claim 1, wherein the ratios between the number of first passages and the number of second passages are different for the two heat exchanging fluids.

* * * * *